United States Patent [19]

Yu

[11] 4,451,556

[45] May 29, 1984

[54] TELLURIUM IMAGING COMPOSITION INCLUDING BASE

[75] Inventor: Terry T. Yu, Mt. Clemens, Mich.

[73] Assignee: Energy Conversion Devices, Inc., Troy, Mich.

[21] Appl. No.: 392,579

[22] Filed: Jun. 28, 1982

[51] Int. Cl.[3] ..... G03C 5/24

[52] U.S. Cl. ..... 430/346; 430/495; 430/936; 430/616; 430/617; 430/353; 430/494

[58] Field of Search ..... 430/346, 495, 936, 616, 430/617, 353, 494

[56] References Cited

U.S. PATENT DOCUMENTS

| | | | |
|---|---|---|---|
| 1,602,589 | 10/1926 | Sheppard et al. | 430/495 |
| 3,147,117 | 9/1964 | Wainer et al. | 430/332 |
| 3,383,212 | 5/1968 | MacLachan | 430/334 |
| 3,527,639 | 9/1970 | Moraw et al. | 430/344 |
| 3,579,342 | 5/1971 | Strilko | 430/340 |
| 3,684,509 | 8/1972 | Van den Heuvel et al. | 430/348 |
| 3,700,448 | 10/1972 | Hillson et al. | 430/424 |
| 3,734,733 | 5/1973 | Poot et al. | 430/353 |
| 3,811,895 | 5/1974 | Ehrlich | 430/495 |
| 3,819,377 | 6/1974 | Klose et al. | 430/20 |
| 3,846,131 | 11/1974 | Lohmann et al. | 430/336 |
| 3,926,637 | 12/1975 | Bartolini et al. | 430/423 |
| 4,062,685 | 12/1977 | Takeda et al. | 430/495 |
| 4,066,460 | 1/1978 | Chang et al. | 430/495 |
| 4,106,939 | 8/1978 | Chang et al. | 430/495 |
| 4,142,896 | 3/1979 | Chang et al. | 430/495 |
| 4,201,588 | 5/1980 | Adin et al. | 430/196 |
| 4,281,058 | 7/1981 | Ovshinsky et al. | 430/495 |
| 4,284,704 | 8/1981 | Fleming et al. | 430/495 |
| 4,340,662 | 7/1982 | Ovshinsky et al. | 430/495 |

FOREIGN PATENT DOCUMENTS

| | | |
|---|---|---|
| 854193 | 11/1977 | Netherlands . |
| 863052 | 7/1978 | Netherlands . |

OTHER PUBLICATIONS

*Research Disclosure:* Item No. 16926, May 1978.

Ovshinsky, "Amorphous Materials as Optical Information Media", *Journal of Applied Photographic Engineering,* V. 3, No. 1, (1977), pp. 35–39.

*Modern Photographic Processing,* vol. 2, pp. 296–301.

*Chemical Abstracts,* No. 20534, May 1981, "Non-Silver Imaging Compositions Having Improved Speeds and Processing Temperatures".

Sprague et al., *Photographic Science and Engineering,* V. 8, No. 2, (1964), pp. 91–103.

Ovshinsky et al., "Non-Silver Photographic Processes", edited by Cox (Academic Press, 1975), pp. 61–70.

Fotland, "Optionally Developed Free-Radical Photosensitive Materials", *Journal of Photographic Science,* V. 18, (1970), pp. 33–40.

Morgan et al., *J. Chem. Soc.,* 1925, vol. 127, pp. 2625–2631.

Morgan et al., *J. Chem. Soc.,* 1929, pp. 1103–1106.

Farran et al., *J. Chem. Soc.,* 1945, pp. 11–14.

Patai, *The Chemistry of the Quinonoid Compounds,* (1974), in particular pp. 494–507 and pp. 755–756.

Cava et al., *JACS* 81, 6458 (1959), "Condensed Cyclobutane Aromatic Compounds, VIII, The Mechanism of Formation of 1,2-Dibromobenzocyclobutene; A New Diels-Alder Synthesis".

*Chem. Ber.,* 80 (1967), pp. 391–401, "59. Friedrich Weygand, Kurt Vogelbach and Konrad Zimmermann: Synthesen von 2.3-Dioxy-naphthochinonen aus substituierten o-Phthalaldehyden und Glyoxal."

Campos et al., *Tetrahedron,* vol. 18, 1962, pp. 521–530, Pergamon Press, N.Y.

Ogawa, *Bulletin of the Chem. Soc. of Japan,* vol. 41, No. 9, 1968, pp. 3031.

*Primary Examiner*—Won H. Louie, Jr.

*Attorney, Agent, or Firm*—Lawrence G. Norris

[57] ABSTRACT

Imaging compositions employing a tellurium compound, a reductant precursor, a masked reducing agent and a source of labile hydrogen are improved by the inclusion of a base which may be inorganic or organic. Suitable inorganic bases include alkali metal hydroxides, alkaline earth metal hydroxides and ammonium hydroxide. Suitable organic bases include amines and heterocyclic nitrogen atom containing compounds.

55 Claims, No Drawings

TELLURIUM IMAGING COMPOSITION INCLUDING BASE

THE PRIOR ART BACKGROUND

Various methods are known for producing images or duplicates of images. The imaging materials used are, in certain cases, particular organic compounds. Some of these heretofore known methods employ mixtures of inorganic compounds such as silver halide with one or more particular types of organic compounds as sensitizers.

A new photographic process using tellurium compounds to provide the image is disclosed in U.S. patent application Ser. No. 596,646 filed July 17, 1975 (now U.S. Pat. No. 4,142,896). In accordance with U.S. Pat. No. 4,142,896, an emulsion is formed using certain reducible tellurium compounds in combination with a reductant precursor in a binder or matrix suitable for forming a film-like coating on a substrate. The film prepared therefrom is exposed image-wise to activating energy and is thereafter developed as is known in the art hereinafter described. Heat development is preferred.

Some tellurium compounds described for use in the photographic process of U.S. Pat. No. 4,142,896 may be represented, for example, by the formula $$R_x—Te—X_y$$

in which R is an organic radical containing at least one carbonyl group, X is a halogen, preferably chlorine, and x is 1, 2 or 3, and $x+y=4$. The organic radical R may be either two independent radicals or may be joined together to form a cyclic compound. Another group of compounds mentioned in U.S. Pat. No. 4,142,896 are organic tellurium compounds which may be considered or characterized as tellurium tetrahalide adducts of ethylenic or acetylenic hydrocarbons. Some of such compounds can be represented by the formulae

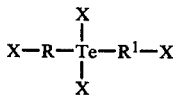

and $$(X—R)_n—Te—X_n$$

wherein R and $R^1$ are each the residue of an ethylenic hydrocarbon and X is a halogen, preferably chlorine.

Another category of photosensitive tellurium compounds which have been found useful are halogenated tellurium compounds, such as compounds of the formula $$TeCl_nBr_m$$

where n is an integer from 2 to 4, and $n+m=4$. The use of such halogenated tellurium compounds in imaging processes is disclosed in U.S. Pat. No. 4,066,460 to Chang et al.

Still another category of useful tellurium compounds are described in U.S. Pat. No. 4,106,939. These compounds are tellurium tetrahalide adducts of aromatic amines in which nitrogen attached directly or indirectly to the aromatic ring is substituted by alkyls of 1–4 carbon atoms, the adduct being free of diazo groups.

The tellurium compounds such as the foregoing may be employed in conjunction with a reductant-precursor which serves as a sensitizer. The reductant-precursor is a compound which, under the influence of activating energy, will absorb radiation energy and abstract labile hydrogen from an appropriate hydrogen donor to become a strong reducing agent. The strong reducing agent reduces the tellurium compound to a divalent tellurium compound or to elemental tellurium. In either event, a change in optical density occurs which results in an imaging suitable for recording information. In general terms, the foregoing reaction may be represented by the following mechanism:

$$PQ \xrightarrow{h\nu} {}^1PQ \longrightarrow {}^3PQ$$

$${}^3PQ + 2RH \longrightarrow PQ.H_2 + R—R$$

$$(R^1)_2.Te.X_2 + {}^2PQ.H_2 \longrightarrow {}^2PQ + 2R^1H{=}Te + 2HX$$

wherein PQ is the reductant precursor sensitizing agent; ${}^1PQ$ is the first excited singlet state thereof; ${}^3PQ$ is the triplet state thereof; RH is the hydrogen donor; $PQ.H_2$ is the reductant precursor in its reduced state; and $(R^1)_2.Te.X_2$ is the reducible tellurium image-forming compound.

In this connection, it should be noted that the hydrogen donor need not be specifically provided, although a variety of alcohols can be used if desired. In the absence of a specially-provided hydrogen donor, the labile hydrogen can sometimes be abstracted from the organic resins used as binders. In other cases, the sensitizer can be its own hydrogen donor, and this is known to be the case with at least one preferred sensitizer, namely, isopropoxynaphthoquinone.

A modification of the tellurium photographic process is described in Belgian Pat. No. 854,193, wherein certain diols of the formula $$R_{10}—CHOH—Z—CHOH—R_{11}$$

may be employed as the hydrogen donor for use in conjunction with the photosensitizer described above. In the foregoing formula, $R_{10}$ and $R_{11}$ represent hydrogen and various organic substituents. Z may be a direct carbon-carbon linkage between the two hydroxy substituted carbon atoms, or may be any of various linking groups. Reference is made to Belgian Pat. No. 854,193 for a fuller description of the diols referred to. In the Belgian patent, these diols are said to serve as hydrogen donors. Subsequent research has suggested that this is not completely accurate. In fact, a major portion of the diol appears to form a complex with the tellurium compound.

This finding has led to the discovery of diols of the general formula $$R—O—CH_2CHOH—CH_2OH$$

which have improved characteristics when used in tellurium-based photographic films.

The radical R may be a simple aliphatic group (for example, alkyl or alkenyl). Alternatively, the radical R may contain a carbonyl group (for example, an acyl radical). Preferably, however, the radical R is aromatic. Best results are obtained where the aromatic ring is separated from the ether oxygen by one methylene grouping. A more complete description of these diols is contained in United States patent application Ser. No. 73,700, filed Sept. 10, 1979, now U.S. Pat. No. 4,281,058, and reference is made thereto for additional descriptions thereof.

Still another modification in the use of tellurium compounds as photosensitive agents involves what is known as a "masked reducing agent". A number of compounds are known, such as phenidone, which will reduce organo-tellurium compounds. The reducing capacity of such compounds may be "masked"—i.e., inhibited—by appropriate substitution. In such cases, if the substituent is one which can be cleaved by the reaction products liberated upon the photoreduction of the tellurium compound, the masked reducing agent can be used to amplify the photoresponse through the mechanism Light + Sensitizer ⟶ Photoactive Reducing Agent Photoactive Reducing Agent + Tellurium Compound ⟶ Tellurium + By-Products By-Products + Masked Reducing Agent ⟶ Demasked Reducing Agent Demasked Reducing Agent + Tellurium Compound ⟶ Tellurium + By-Products Since the organo-tellurium compounds commonly used release hydrogen halides (particularly hydrogen chlorides) as by-products of the reduction reaction, and the reducing agents, such as phenidone, are amino compounds, the masking agents most effectively employed are compounds which will convert the amino nitrogen into an amide. A typical masked reducing agent thus is the compound

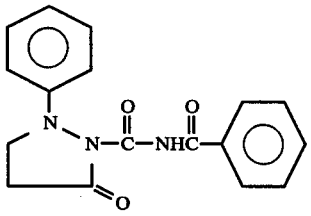

A more complete description of masked reducing agents may be found in Belgian Pat. No. 863,052 of July 19, 1978, and reference thereto is made for additional descriptions thereof.

As an alternative to the masked reducing agents described in Belgian Pat. No. 863,052, a new class of masked reducing agents may be substituted, represented by the general formulae $R^1—NY—NY_2$ -continued

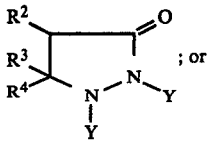

; or

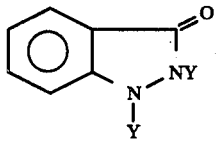

wherein Y is hydrogen or $\overset{O}{\overset{\|}{C}}NHR^5$, said compound containing at least one $\overset{O}{\overset{\|}{C}}—NH—R^5$ group. In the foregoing formulae, $R^1$ may be alkyl, alkanoyl, alkoxycarbonyl, phenyl, benzyl, benzoyl, nitrophenyl, benzylcarbonyl, phenylmethyl, phenylethyl or phenylpropylcarbonyl, or aminocarbonyl. $R^2$, $R^3$ and $R^4$ each, and independently, may be hydrogen, alkyl or phenyl and amino. $R^4$ may be phenyl, nitrophenyl, halophenyl, alkyl, mono-, di- or tri-haloalkyl, benzoyl, alkylphenyl, or alkylcyanophenyl. The masking group may be substituted at either one or both of the amino hydrogen sites of the reducing agent. The alkyl groups referred to above may contain up to seven carbon atoms. Such compounds are conveniently acceptable through reaction of the parent hydrazine or pyrazoline with an isocyanate of the formula $R^5—N=C=O$ A more complete description of these masked reducing agents is found in U.S. patent application Ser. No. 277,720, filed June 26, 1981 and reference thereto is made for additional descriptions thereof.

In practice, the foregoing ingredients, i.e., a tellurium derivative, a reductant precursor sensitizer, and additional ingredients such as the glycol and masked reducing agent, are combined in a suitable matrix to form an emulsion which may be spread into a film on an appropriate carrier or substrate. A latent image in the film is formed by exposure to imaging energy, for example, a light image.

After formation of the latent image, a visible image is developed by heating the exposed film as described in U.S. Pat. No. 4,142,896.

The speed or light sensitivity of the film is determined by the amount of energy necessary to produce an image. For many applications it is desirable to have an imaging film that is relatively fast, and in addition, has a low optical density relative to the optical density of the image formed by the film.

SUMMARY OF THE INVENTION

In accordance with the invention, the above described organo-tellurium imaging system containing a tellurium compound, a reductant precursor and a masked reducing agent is improved. More specifically, I have discovered that a base can be included in the imaging film composition for improving the performance of the film. The inclusion of a base provides the unexpected result of improving the speed (light sensitivity) and/or improving the optical density of the exposed portions after development of imaging film made with such compositions. The inclusion of a base may also reduce the background fog or optical density of unexposed portions of the film. The compositions may contain other components, as discussed.

The base may be organic or inorganic and should be sufficiently alkaline to ionize the masked reducing agent or otherwise beneficially affect the composition. In general, any base which improves the performance of the film, such as, for example, increased speed, increased optical density of exposed portions or decreased fog of unexposed portions, can be utilized. Preferably, bases which produce unwanted deleterious effects will be avoided. Suitable inorganic bases include, for example, metal hydroxides and ammonium hydroxide. More specifically, alkali metal hydroxides and alkaline earth metal hydroxides can be utilized. Useful alkali metal hydroxides include those of lithium, sodium, potassium, rubidium and cesium. Lithium hydroxide is the preferred alkali metal hydroxide. Useful alkaline earth metal hydroxides include those of magnesium, calcium and barium. The hydrated form of the metal hydroxide can be used. It is anticipated that more than one base can be included in the imaging film composition.

Alternatively, the organic base may be an aliphatic amine compound or a nitrogen atom containing heterocyclic compound.

Suitable amines for use in accordance with the invention include primary, secondary and tertiary amines which may be aliphatic or aromatic. More particularly, suitable amines are those such as, for example, methylamine, dimethylamine, trimethylamine, ethylamine, diethylamine, triethylamine, n-, di-n- and tri-n-propylamine, isopropylamine, n-butylamine, isobutylamine, di-n-butylamine, tertbutylamine, and n-tetradecylamine. In general, those amines of the following formula may be suitable:

$$R—NH_2$$

where R is aliphatic (for example $CH_3$, $C_2H_5$, $C_3H_7$, etc.).

The R radical may be unsubstituted or substituted by various organic or inorganic radicals, which do not interfere with the desired imaging effect.

Cyclic compounds, such as pyridine and piperidine, are also suitable, and may be unsubstituted or substituted by various organic or inorganic radicals, which do not interfere with the desired imaging effect.

It is believed that the base ionizes the masked reducing agent facilitating the formation of a complex between the ionized masked reducing agent, positive tellurium ions and the latent image formed by the reductant precursor after exposure of the film to imaging energy. The complex is believed to be very susceptible to electron transfer, facilitating formation of a visible image.

In general, alkaline earth or alkali metal hydroxides are preferred over organic bases. The metal ions from the base may form a beneficial complex with the reductant precursor which makes the reductant precursor more active.

The amount of base present in the film-forming composition is variable. Generally, there is no minimum amount of base required to provide an improved film. However, the degree of improvement is related to the amount of base present, up to a certain amount, for each particular film formulation and base. Beyond that amount, generally the photoresponse of the film diminishes. The optimum amount of a particular base for a particular formulation can easily be determined simply by formulating film-forming compositions containing various amounts of a particular base and testing the performance of the films made therefrom. For example, for the films set forth in Example 8, the optimum amount of ammonium hydroxide was about 0.16 moles per mole of tellurium imaging compound. For the films set forth in Examples 2 and 6, the optimum amount of sodium hydroxide was about 0.13 moles per mole of tellurium imaging compound. For the films set forth in Examples 4 and 10, the optimum amount of lithium hydroxide (with one water of hydration) was about 0.05 moles per mole of tellurium imaging compound.

DETAILED DESCRIPTION OF EMULSIONS ACCORDING TO THE PRESENT INVENTION

An emulsion formulated in accordance with the present invention contains a tellurium compound, a reductant precursor, a masked reducing agent, an appropriate binder, and a base of the above description. Optionally, other components may also be included in the emulsion. A diol may be included, preferably a glyceryl compound of U.S. Pat. No. 4,281,058. An alcohol may also be included, preferably when a glyceryl compound of U.S. Pat. No. 4,281,058 is included, as disclosed in copending U.S. patent application Ser. No. 392,580, filed June 28, 1982. Water may also be included, as set forth in copending U.S. patent application Ser. No. 392,576, filed June 28, 1982.

It is anticipated that reducible organo-metallic imaging compounds and other reducible metal compounds, other than tellurium compounds, may be utilized in accordance with the invention. For example, other metals which can form organo-metallic imaging compounds, include copper, silver, nickel, mercury and cobalt. For example, cobalt imaging compounds are disclosed in U.S. Pat. No. 4,201,588 to Adin et al. Specific organo-metallic compounds which may be used include, for example, copper-2,4-pentanedionate, nickel-2,4-pentanedionate, mercury acetate and silver behenate.

The image-forming tellurium: A number of image-forming tellurium compounds are described in the prior art and such compounds are generally useful in the present invention. In general, the present invention contemplates using these and other tellurium compounds which undergo analogous reduction reactions in the presence of a reductant precursor as hereinafter described.

It has been found that many tellurium compounds possess certain properties which adapt them especially for use in imaging processes. In general, these are compounds from which, as a result of the imaging and developing steps generally referred to above, elemental tellurium is deposited from the tellurium compounds. Tellurium is chain-forming in character, and it is generally deposited from the tellurium compounds useful for photographic purposes (preferably including thin needles), the compounds being capable of rapid nucleation and growth as crystallites, which crystallites grow as chains and largely or mainly as needles. Such chains or needles are opaque and are characterized by excellent light scattering properties to produce good optical density observed after thermal or other development.

Effects which may involve oxide formation are substantially restricted to surface effects as distinguished from effects which cause degradation through the bodies of the needles or chains.

Preferably, the tellurium imaging compound is an organo-tellurium compound such as disclosed in U.S. Pat. No. 4,142,896 of Chang et al. These compounds are organic tellurium compounds which inherently possess sensitizer properties (and/or may be mixed with a separate sensitizer) in which the tellurium is linked directly to at least one carbon atom or the organic radical of the organo-tellurium material, the organic tellurium compound being of one structure and having a detectable characteristic which is capable of undergoing a change in response to the application of imaging energy in the form of particle or wave radiation to produce a material of different structure having another detectable characteristic. The material having a different structure and different detectable characteristics resulting from the imaging step is sometimes referred to as the "image-forming compound".

The tellurium imaging compound may be an organometallic compound such as those disclosed in U.S. Pat. No. 4,062,685, which is hereby incorporated by reference.

A particularly advantageous subgroup of the imaging organo-tellurium compounds utilized in the practice of the present invention comprises organic compounds which contain an organo radical and halogen attached directly to the tellurium atom, there being at least one carbonyl group in the organo radical. Certain of them are adducts of tellurium halides, notably tellurium tetrachloride, with organic compounds, notably ketones or similar chromophores, containing at least one carbonyl group in the organic compound. They may, thus, be considered or characterized as organo-tellurium compounds or adducts containing halogen, namely, chlorine, bromine, iodine, and fluorine, attached directly to the tellurium atom. Most of this particular class or group of said imaging compounds have two carbonyl-containing organo radicals. Those which are especially useful in the practice of the present invention have chlorine as the halogen but, in certain cases, although generally less satisfactory, other halogens can be present. The imaging compounds should be selected to be soluble or homogeneously dispersible in any particular matrix material which may be utilized, as is described hereafter. Many of this group of imaging organo-tellurium compounds may be represented by the formula $$R_x\text{—Te—Hal}_y$$

where R is an organo radical containing at least one carbonyl group, Hal is halogen, especially chlorine, x is 1, 2 or 3, and $x+y=4$, subject to the proviso that Te is linked directly to carbon in an organo radical. Preferably, x is 2 or 3.

Others can be represented by the formula $$R_2\text{—Te—Hal}_4$$

where R is a carbonyl-containing organic radical, and Hal is halogen.

The R radical can be aliphatic, cycloaliphatic or aromatic (mononuclear or dinuclear) or a combination thereof and may contain one or more hetero atoms in the chain or rings. It may be unsubstituted or substituted by various organic or inorganic radicals, which may assist in or at least do not interfere with the desired imaging effect, illustrative of such radicals being $C_1$–$C_6$ alkyl, corresponding oxyalkyl radicals, acetyl, nitro C≡N, Cl, Br, F, etc. Generally speaking, the aforesaid organo-tellurium imaging compounds which contain a trihalide group as, for instance, acetophenone tellurium trichloride, tend to have relatively low melting points (about 70°–80° C.), and are more hygroscopic and less stable than those generally similar compounds containing two halogen atoms and, therefore, such trihalides are less desirable for use in the practice of the present invention.

A more limited class of this particular subgroup of imaging organo-tellurium compounds may be represented by the formula $$(\text{AR—CO—CH}_2)_2\text{Te—Hal}_2$$

where Ar is an aromatic hydrocarbon radical, which may be substituted or unsubstituted, as indicated above, and Hal is halogen, especially chlorine. This subgroup of compounds, particularly where Hal is chlorine, represents especially advantageous embodiments of the invention, with respect to the imaging organo-tellurium compounds are used in the practice of the present invention.

Another subgroup of imaging organo-tellurium compounds, useful in the practice of and contemplated by the present invention, which do not contain a carbonyl group in an organo radical but in which tellurium is linked directly to carbon are compounds which may be considered or characterized as tellurium tetrahalide adducts of ethylenic or of acetylenic hydrocarbons. These compounds are generally conveniently produced by reacting 1 to 2 moles, particularly 2 moles, of the ethylenic or acetylenic hydrocarbon with 1 mole of tellurium tetrahalide, especially preferred for such use being $TeCl_4$. Certain of such compounds can be represented by the formulae:

$$\text{Hal—R}^7\text{—}\underset{\underset{\text{Hal}}{|}}{\overset{\overset{\text{Hal}}{|}}{\text{Te}}}\text{—R}^6\text{—Hal; and}$$

$$(\text{Hal—R}^7)_x\text{—Te—Hal}_y$$

where $R^6$ and $R^7$ are each of the residue of an ethylenic hydrocarbon, for instance, an alkene or a cycloalkene, Hal is chlorine, bromine or iodine, especially chlorine, x is 1 to 3, and $x+y=4$.

Illustrative of the ethylenic and acetylenic hydrocarbons which can be adducted with tellurium tetrahalides to produce such imaging organo-tellurium compounds are propylene; butene-1; isobutylene; butene-2; 2,3-dimethyl-2-butene; 3,3-dimethyl-1-butene; 2,4-dimethyl-1-pentene; 4,4-dimethyl-1-pentene; 2,5-dimethyl-3-hexene; dipentene; 1,1-diphenylethylene; 1-heptene; 1-hexene; 2-methyl-1-hexene; 3-methyl-1-hexene; 4-methyl-1-hexene; 2-ethyl-1-hexene; 2-isopropyl-1-hexene; 2-methyl-1pentene; 2-methyl-2-pentene; 2-ethyl-2-pentene; 3-methyl-1-pentene; piperylene; vinylcyclohexene; vinylcyclopentene; 2-vinylnaphthalene; 1,2,4-trivinylcyclohexene; 4-methyl-1-cyclohexene; 3-methyl-1-cyclohexene; 1-methyl-1-cyclohexene; 1-methyl-1-cyclopentene; cycloheptene; cyclopentene; cyclohexene; 4,4-dimethyl-1-cyclohexene; 2-methylbutene-1; 3-methylbutene-1; and 1-octene; lower alkyl and lower alkoxy derivatives of various of the alkenes such as cyclohexene; 1-pentyne; 2-pentyne; 1-hexyne; and 3-methyl-1-butyne.

The preparation of the aforementioned organic tellurium compounds as well as many examples thereof are more fully set forth in U.S. Pat. No. 4,142,896, which is hereby incorporated by reference.

As indicated above, tetrahalides of tellurium in which the halide is at least one member selected from the group consisting of chlorine and bromine are also useful as the image-forming material in the present invention. Such tellurium halides are fully described in U.S. Pat. No. 4,066,460, which is hereby incorporated by reference. Certain of these imaging materials can be represented by the formula $$TeCl_nBr_m$$

where n is an integer from 1 to 4 and $m+n=4$. Typical tellurium tetrahalides which may be used are $TeCl_4$; $TeCl_2Br_2$; and $TeClBr_3$. $TeCl_4$ is especially useful. Reference is made to U.S. Pat. No. 4,066,460 for a fuller description of these tellurium tetrahalides and their use as image-forming compounds.

Still another group of image-forming compounds are certain compounds derived from tellurium tetrahalides which are described in U.S. Pat. No. 4,106,939 to Change et al. These involved compounds are adducts of tellurium tetrahalide with aromatic amines exemplified by the tellurium tetrachloride adduct of dimethylaniline, which adduct is free of diazo groups. More specifically, these tellurium tetrahalide adducts are formed by combining a tellurium tetrahalide with an aromatic amine in which nitrogen attached directly or indirectly to the aromatic radical is substituted by alkyls containing from 1 to 4 carbon atoms, the imaging organo-tellurium material being free from diazo groups.

These aromatic amine adducts of the tellurium tetrahalides are fully described in U.S. Pat. No. 4,106,939 to Chang et al., which is hereby incorporated by reference.

The active tellurium compounds may, if desired, be formed in situ, for example, by using a tellurium oxide or a tellurium salt in combination with a suitable organic compound. Sometimes the in situ formation is promoted by the presence of an acid. For example, bis(acetophenone) tellurium dichloride or tellurium oxide or alkali metal tellurates may be combined with one of the glycols described below to form a tellurium-organic compound complex which is active. It is believed that the reaction is analogous to the reaction between organic tellurium compounds such as described above and a diol. Preliminary information suggests that the reaction is favored by an acidic medium. Small amounts of an acid such as anhydrous hydrogen chloride may be added. Alternatively, halogen-containing tellurium compounds will provide the requisite acidity.

The reductant precursor: In addition to the tellurium image-forming compound, the imaging systems of the present invention may include a reductant precursor, or sensitizer, which, as described above, is a compound that, under the influence of activating energy, has the property of extracting labile hydrogen from a hydrogen donor to become a reducing agent with respect to the image-forming tellurium compound. The activated reducing agent then reduces the tellurium compound to produce the desired image. The hydrogen donor may be an external source of hydrogen such as an alcohol specifically provided for the purpose. However, the hydrogen donor may equally well be an appropriate group which is a part of the molecular structure of the reductant precursor.

Preferred reductant precursors useful in the present invention are quinones, particularly 2-isopropoxynaphthoquinone; 9,10-phenanthenequinone; and 2-t-butylanthraquinone. Other preferred reductant precursors are disclosed in application Ser. No. 392,586, filed June 28, 1982. Other specific reductant precursors include: 3-chloro-2-isopropoxy-1,4-naphthoquinone; 3-chloro-2-isopropoxy-1,4-anthraquinone; 3-chloro-2-isopropoxy-6,7-diphenyl-1,4-naphthoquinone; 3-chloro-2-(3'-Pentoxy)-1,4-naphthoquinone; 3-chloro-2-(2'-butoxy)-1,4-naphthoquinone; 3-chloro-2-(3',3'-dimethyl-2'-butoxy)-1,4-naphthoquinone; 2,3-diisopropoxy-1,4-naphthoquinone; 3-chloro-2-methoxy-1,4-naphthoquinone; 2,3-dimethoxy-1,4-naphthoquinone; 3-chloro-2-(t-butoxy)-1,4-naphthoquinone; 3-chloro-2-ethoxy-1,4-naphthoquinone; 3-chloro-2-(n-butoxy)-1,4-naphthoquinone; 3-chloro-2-(2'-methylpropoxy)-1,4-naphthoquinone; and 2-isopropoxy-1,4-anthraquinone. Especially useful reductant precursors from the aforementioned group include 3-chloro-2-isopropoxy-1,4-naphthoquinone, 3-chloro-2-isopropoxy-1,4-anthraquinone and 2,3-diisopropoxy-1,4-naphthoquinone. These reductant precursors exhibit good sensitivity to electromagnetic radiation in the visible range, while allowing the film to have good speed.

Benzophenone, although not a quinone, is also useful as a reductant precursor, as are a number of the simpler ketones.

A factor of importance in the selection of reductant precursors is the spectral range to which the reductant precursors respond. For that reason, the simple ketones are not generally useful for recording visible light since their spectral sensitivity is in the far ultraviolet region.

The following are illustrative reductant precursors which are sensitive in the range of up to about 400 nm and, therefore, are useful only in the ultraviolet range: Benzophenone; acetophenone; 1,5-diphenyl-1,3,5-pentanetrione; ninhydrin; 4,4'-dibromobenzophenone; and 1,8-dichloroanthraquinone.

Various other reductant precursors can be utilized, particularly those of the type of substituted or unsubstituted polynuclear quinones, of which class some have been mentioned above, and others of which are 1,2-benzanthraquinone; 2-methylanthraquinone; 1-chloroanthraquinone; 7,8,9,10-tetrahydronaphthacenequinone; 9,10-anthraquinone; and 1,4-dimethylanthraquinone. It will be understood that not all reductant precursors will be effective or equally effective, with each given imaging material, even taking into account the utilization of imaging energy in the sensitivity range of the reductant precursor employed and that suitable selections of combinations of particular imaging materials and particular reductant precursors will be required to be made for achieving desirable or optimum results. Such selections, however, can be made relatively readily.

In general, in connection with the foregoing matters, it may be noted that reductant precursors have $\eta\pi^*$ states, both singlet and triplet, of lower energies than $\pi$, $\pi^*$ states and, at least in most cases, compounds which have their $\pi$, $\pi^*$ states of lowest energy will not be photosensitively effective, although, in certain limited cases, compounds which fulfill the test of having lower energy $\eta \rightarrow \pi^*$ than $\pi \rightarrow \pi^*$ transitions do not function as reductant precursors. However, the above consideration is, in the main, an effective one for determining in advance whether a given compound will function as a reductant precursor for use in the practice of the present invention. In any event, a simple preliminary empirical test in any given instance can readily be carried out if necessary by preparing a test emulsion using the desired imaging compound and reductant precursor.

In some cases an external sensitizer is not needed. For example, at wavelengths in the region of 250–300 nm most organo-tellurium compounds are directly photolyzed; and certain other tellurium compounds, notably the halides, are sensitive to the blue portions of the visible spectrum. When imaging is to be accomplished by electrons, no additional sensitizer is needed since the electron effects direct decomposition of the imaging material.

Preparation of certain preferred reductant precursors is now described. Generally, to form the preferred naphthoquinones or anthraquinones, a suitable starting material is reacted with a suitable alkoxide to form the desired reductant precursor.

When it is desired to form a reductant precursor of the general formula

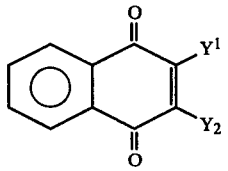

wherein $Y_1$ is alkoxy and $Y_2$ is alkoxy or chloro, 2,3-dichloro-1,4-naphthoquinone is reacted with a metal alkoxide, such as a sodium alkoxide, the alkoxide corresponding with the desired alkoxy group. The metal alkoxide can be formed by reacting an alcohol with an active metal, such as sodium. For example, the reaction of sodium with isopropanol yields sodium isopropoxide. Thus, to prepare 2,3-diisopropoxy-1,4-naphthoquinone, sodium isopropoxide is reacted with 2,3-dichloro-1,4-naphthoquinone, preferably at room temperature, forming 2,3-diisopropoxy-1,4-naphthoquinone. 2-chloro-3-isopropoxy-1,4-naphthoquinone is prepared in a similar manner, except that the alkoxide is added slowly to a cooled (preferably 0°–5° C. or about ice bath temperature) suspension of 2,3-dichloro-1,4-naphthoquinone. In this manner, only one of the chloro groups is replaced by an isopropoxy group. Other reductant precursors having one alkoxy group and one chloro group, such as 3-chloro-2-(2'-butoxy)-1,4-naphthoquinone, 2-chloro-3-isopropoxy-1,4-anthraquinone and 2-chloro-3-isopropoxy-6,7-diphenyl-1,4-naphthoquinone, can be prepared in a similar manner. The latter two compounds would be prepared from 2,3-dichloro-1,4-naphthoquinone and 2,3-dichloro-6,7-diphenyl-1,4-naphthoquinone, respectively.

If $Y_1$ and $Y_2$ are different alkoxy, one alkoxide is added slowly to replace one chloro and the product recovered and then the product is reacted in a similar manner with the other alkoxide.

Reductant precursors of the general formula

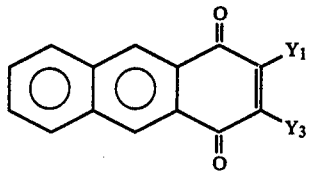

where $Y_1$ is alkoxy and $Y_3$ is hydrogen, chloro or alkoxy can be prepared by reacting 2-chloro-1,4-anthraquinone (if $Y_3$ is to be hydrogen) or 2,3-dichloro-1,4-anthraquinone (if $Y_3$ is to be chloro or alkoxy) with a suitable metal alkoxide as previously described with respect to the naphthoquinones.

Reductant precursors of the general formula

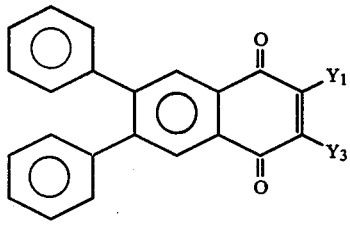

where $Y_1$ is alkoxy and $Y_3$ is hydrogen, chloro or alkoxy can be prepared by reacting 2,3-diphenylbutadiene with 2,3-dichlorobenzoquinone in acetic acid to give 2,3-dichloro-6,7-diphenyl-1,4-naphthoquinone, which is then reacted with a metal alkoxide as previously described with respect to 2,3-dichloro-1,4-naphthoquinone. Alternatively, where $Y_3$ is hydrogen, 2-chlorobenzoquinone is utilized in place of 2,3-dichlorobenzoquinone.

The Masked Reducing Agent: In accordance with the invention, a masked reducing agent is included. A typical masked reducing agent thus is the compound 1-phenyl-2-benzoylamido-3-pyrazolidinone

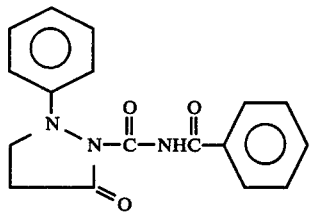

A more complete description of masked reducing agents may be found in Belgian Pat. No. 863,052 of July 19, 1978, and reference thereto is made for additional descriptions thereof.

As an alternative to the masked reducing agents described in Belgian Pat. No. 863,052, a new class of masked reducing agents may be substituted, represented by the general formulae

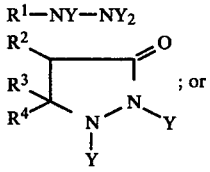

; or

-continued

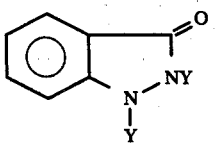

wherein Y is hydrogen or $$\overset{O}{\overset{\|}{C}}NHR^5,$$

said compound containing at least one $$\overset{O}{\overset{\|}{C}}-NH-R^5$$

group. In the foregoing formulae, $R^1$ may be alkyl, alkanoyl, alkoxycarbonyl, phenyl, benzyl, benzoyl, nitrophenyl, benzylcarbonyl, phenylmethyl, phenylethyl or phenylpropylcarbonyl, or aminocarbonyl. $R^2$, $R^3$ and $R^4$ each, and independently, may be hydrogen, alkyl or phenyl and amino. $R^4$ may be phenyl, nitrophenyl, halophenyl, alkyl, mono-, di- or tri-haloalkyl, benzoyl, alkylphenyl, or alkylcyanophenyl. The masking group may be substituted at either one or both of the amino hydrogen sites of the reducing agent. The alkyl groups referred to above may contain up to seven carbon atoms. Such compounds are conveniently accessible through reaction of the parent hydrazine or pyrazoline with an isocyanate of the formula $$R^5-N=C=O$$

A more complete description of these masked reducing agents is found in U.S. patent application Ser. No. 277,720, filed June 26, 1981 which is hereby incorporated by reference.

The Diol: In accordance with the present invention, there may also be included a diol which reacts with the tellurium compound to form an active intermediate complex. While the chemistry of the complex is not well understood, we believe that, in general, the complex requires approximately 2 moles of diol for each mole of tellurium. Preferably, the diol, when present, is used in excess of the minimum amount to form a complex since the diol will also function as a source of labile hydrogen to provide the source of hydrogen required in the reaction of the reductant precursor.

While the present invention involving the use of a base can be practiced without the inclusion of a diol, the presence of a diol is preferred especially when a masked reducing agent is present. The presence of a diol serves to markedly reduce the optical density of unexposed areas (i.e., thus increasing the contrast between the exposed and unexposed areas). Thus, while masked reducing agents can be used in the absence of a diol, tellurium film compositions containing masked reducing agents tend to have a relatively high optical density in the unexposed areas because the reducing capacity of the masked reducing agent is not fully inhibited by the masking group.

One group of diols which may be used in formulating imaging compositions are diols of the formula

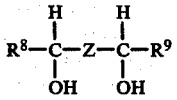

wherein each of $R^8$ and $R^9$ independently represents hydrogen, a hydrocarbon group, including straight chain, branched chain and cyclic hydrocarbon groups, hydroxyalkyl groups, alkoxycarbonyl groups, cycloalkyl groups or aryl groups; and Z represents an arylene group (for example, phenylene), the group (—C≡C—), the group $(-CR^{10}=CR^{11})_n$, wherein n represents a whole number, for example, 1 or 2, and each of $R^{10}$ and $R^{11}$ represents hydrogen or an alkyl group or taken from part of a carbocyclic or heterocyclic ring. Z also may be omitted—that is, the two hydroxy-substituted carbons are joined directly to each other. The following table illustrates a number of diols which may be used:

| No. of the Compound | $R^8$ | Z | $R^9$ | Boiling Point (BP) °C. or Melting Point (MP) °C. |
|---|---|---|---|---|
| 1 | H | — | H | BP 198 |
| 2 | 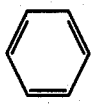 | — | H | MP 67 |
| 3 | $H_3C-$ | — | H | BP 189 |
| 4 | $H_3C-$ | — | $-CH_3$ | BP 183 |
| 5 | H | —C≡C— | H | MP 52-54 |
| 6 | H | 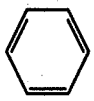 | H | MP 112 |
| 7 | $HO(CH_2)_4-$ | — | H | BP 178/5 mm Hg |
| 8 | $C_2H_5O\overset{O}{\overset{\|}{C}}-$ | — | $C_2H_5O-\overset{O}{\overset{\|}{C}}-$ | BP 280 |

A fuller description of the foregoing diols may be found in Belgian Pat. No. 854,193, the disclosure of which is hereby incorporated by reference.

Preferably, however, the diol is of a more complex type than disclosed in the above-mentioned Belgian patent application. These more complex diols are the subject matter of U.S. Pat. No. 4,281,058, which is hereby incorporated by reference.

The preferred diols, as described in U.S. Pat. No. 4,281,058, are compounds of the formula $$R^{12}-O-CH_2-CHOH-CH_2OH$$

In the foregoing compound, $R^{12}$ may be alkyl, acyl, thiazolinyl, alkenyl, phenyl, alkylphenyl, alkenylphenyl, hydroxyalkylphenyl, benzyl, alkylbenzyl, alkoxybenzyl, hydroxyalkylbenzyl, and halobenzyl and similar radicals.

The "thio" analogs of the foregoing compounds can be used (i.e., compounds in which the radical $R^{12}$ is joined to the glycerol residue by a thio linkage in place of the oxy linkage.)

Preferred compounds of the foregoing structure are those in which the radical $R^{12}$ is benzyl or a substituted benzyl. The use of the diols of the foregoing structure has been found to be preferred since they are more effective in reducing the optical density of the unexposed areas than are the diols described in Belgian Pat. No. 854,193.

Ancillary Ingredients: In addition to the foregoing principal ingredients of the present formulation, ancillary ingredients may be included for various purposes. Thus, for example, it has been found that certain materials enhance the shelf life of unexposed virgin dry film compositions of the present invention, and in certain instances, they also enhance the sensitivity of said film compositions. Illustrative embodiments of such additional or supplemental materials, which contain ether or polyether linkages in the molecules thereof, are such materials or polymers as polyethylene-20 sorbitan monolaurate; polyethylene-20 sorbitan monooleate; Polyoxy-10; Polyox-80; Polyox-750; polyethylene glycol-400 distearate; polyethylene glycol-600 distearate; poly (1,3-dioxolane); poly (tetrahydrofuran); poly (1,3-dioxepane); poly (1,3-dioxane); polyacetaldehydes; polyoxymethylenes; fatty acid esters of polyoxymethylenes; poly (cyclohexane methylene oxide); poly (4-methyl-1,3-dioxane); polyoxetanes; polyphenylene oxides; poly [3,3-bis (halomethyl) oxocyclobutane]; poly (oxypropylene) glycol epoxy resins; and copolymers or propylene oxides and styrene oxides. Such materials can be incorporated in the imaging film compositions in varying amounts, generally from 5 to 20% by weight of the solid imaging film compositions. In certain cases they enhance or prolong the shelf life or storage life, under given storage conditions, as much as 50% or even very substantially more timewise, and, as indicated, they also, in various cases, effectively increase film sensitivity.

Again, the inclusion in the imaging films of reducing sugars has been found, generally speaking, to bring about an enhancement in density of the image area (O.D. image-O.D. background), when the film is imaged as disclosed above and then developed, for instance, at about 120°–150° C. and for the order of about 15 seconds, especially where the imaging film is freshly prepared or not older than about a day after initial preparation. Such films, when exposed to imaging energy and then developed resulted in the production of a positive image (i.e., the optical density is greater in the nonexposed areas than in the exposed areas) in contrast to the negative working system which exists in the usual practice of the present invention. The inclusion of reducing sugars in the imaging compositions also enables development of the image, after exposure to imaging energy, to take place at lower temperatures, even at room temperatures, in a period of several hours, for instance, commonly in 10, 12 or 15 hours. The reducing sugars which can be employed are many, illustrative of which are dextrose, glucose, arabinose, erythrose, fructose, galactose, fucose, mannose and ribose. Especially effective are dextrose, arabinose, galactose, fucose and ribose. The reducing sugars can be used in variable amounts, but generally in equivalent amounts, or somewhat smaller or greater, in relation to the amount of imaging organo-tellurium materials in the imaging compositions.

It may be desirable in many cases to include a small amount of silicone oil or similar material as is well known to aid in coating of smooth continuous films.

Several other ancillary ingredients may be utilized, which can have the effect of increasing the sensitivity of the film and/or optical density after exposure. These ancillary ingredients include: indoaniline dyes of the general formula

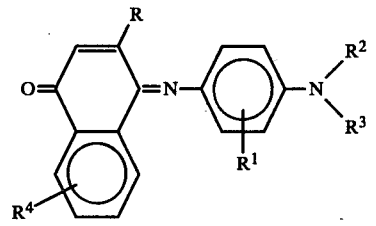

where $R^1$–$R^4$, may be, each and independently by hydrogen or alkyl (N,N-(p-dimethylaminophenyl)-1,4-naphthoquinone (indophenol blue) for example); indane-1,3-dione derivatives such as 2-phenylindane-1,3-dione; and cyamine dyes of the general formula

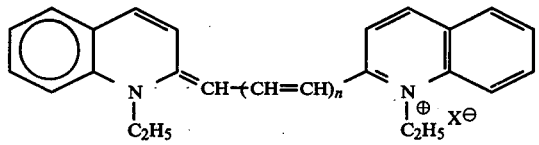

where n=1, 2 or 3 and x is chloro or iodo (1,1'-diethyl-2,2'-carbocyamine chloride (pinacyanol chloride), for example. Care should be taken to insure that the matrix material does not absorb undesired components, such as water from the atmosphere.

The matrix material: A film composition in accordance with the present invention is completed by dissolving the ingredients and optional ingredients described above in a suitable matrix. The matrix should be as concentrated as is practicable in the active ingredients, i.e., the least amount of matrix is preferably used. The amount of matrix should be sufficient as to just retain the various active ingredients in a solid solution. An additional quantity of matrix may be used, however, that obviously tends to dilute the concentration of active ingredients, thereby slowing down the photoresponse of the film composition. The selection of matrix materials, of course, must be related to the active ingredients used so as to provide the maximum solubility for any particular composition.

The matrix materials, into which the imaging organo-tellurium materials, and the separate sensitizers when employed, are incorporated to produce the imaging film or coating, are solids at room temperature, and they can be selected from a relatively large number of materials. They should desirably be at least in part of amorphous character and it is especially desirable that they be glassy, polar amorphous materials having a glass transition temperature, which desirably should not exceed about 200° C. and may be as low as about 50° C., and, better still, should be within the range of about 80°–120° C. They are generally polymeric materials. Illustrative thereof are cyanoethylated starches, celluloses and amyloses having a degree of substitution of cyanoethylation of ≧2; polyvinyl-benzophenone; polyvinylidene chloride; polyethylene terephthalate ("MYLAR"); cellulose esters and ethers such as cellulose acetate, cellulose propionate, cellulose butyrate, cellulose acetate butyrate, acetyl cellulose, methyl cellulose, ethyl cellulose, hydroxypropyl cellulose, polyvinylcarbazole; polyvinyl chloride; polyvinyl methyl ketone; polyvinyl alcohol; polyvinylpyrrolidone; polyvinyl methyl ether; copolymers of vinylidene chloride and acrylonitrile; polyvinyl acetate, polyvinyl butylral; polystyrene, polymethyl methacrylate; polyvinyl pyrrolidone; styrenebutadiene copolymers; polyamides; polyacrylic and polymethacrylic alkyl esters such as polymethyl methacrylate and polyethyl methacrylate; copolymer of polyvinyl methyl ether and maleic anhydride; various grades of polyvinyl formal resins such as so-called 12/85, 6/95E, 15/95S, 15/95E, B-79, B-98, and the like, sold under the trademark "FORMVAR"—(Monsanto Company). Of special utility is polyvinyl formal 15/95% which is a white, free flowing powder having a molecular weight in the range of 24,000–40,000 and a formal content expressed as percent polyvinyl formal of approximately 82%, possessing high thermal stability, excellent mechanical durability, and resistance to such materials as aliphatic hydrocarbons, and mineral, animal and vegetable oils. These polymeric materials or resins and their preparation are well known to the art. Also of special utility are various grades of cellulose acetate butyrate polymers sold by the Eastman Kodak Company under the trade designation "CAB", particularly "CAB 500-5".

In addition to their functioning as carriers for and holding together in a unitary composition the imaging organo-tellurium materials, sensitizers and any other ingredients which may be incorporated into the imaging film or coating or layer and their functioning as dry or essentially dry film-forming materials to provide thin films and providing mechanical durability in the finished imaged film, at least many of them appear also to play a chemical or physical role in the imaging process by providing, importantly, a source of readily easily abstractable hydrogen and, thus, appear to play a significant role in the latent image formation mechanism, as discussed hereafter. In certain instances, it may be desirable to decrease the viscosity of the matrix, which can be done, by way of illustration, by the addition of certain plasticizers, for instance, dibutylphthalate or diphenylphthalate, which additions tend to result in the production of images desirably of higher optical densities but which, however, also tend to have the disadvantage of increasing background fogging.

It may be noted that matrix materials of the type which contain basic groups may complex with the imaging organo-tellurium materials and, therefore, to the extent that such complexing may occur, the use of such matrix materials should be avoided.

Water: The compositions may also include water. A small quantity of water, generally added to the matrix material before combining with the other components of the film-forming composition, serves to improve the speed of the film. However, too much water may cause a tellurium oxide to be precipitated when the components of the film-forming composition are combined, and this should be avoided. For a more complete description of the inclusion of water, reference is made to U.S. patent application Ser. No. 392,576, filed June 28, 1982.

Alcohol: An alcohol may be included in the compositions of the invention. Preferably, the alcohol will be utilized when a diol as previously described is present in the composition. The alcohol and diol may form a complex with the tellurium compound, providing a film having enhanced speed and/or improved background fog. The alcohol may be primary, secondary or tertiary. Primary monohydric alcohols are preferred, such as n-butanol and n-propanol, for example. For a more complete description of the inclusion of an alcohol, reference is made to U.S. patent application Ser. No. 392,580, filed June 28, 1982.

Formulation of Film Compositions: In the production of the films or thin layers of the imaging material compositions, which are generally prepared in the form of solutions or homogeneous dispersions and coated or laid down on a substrate, it is especially desirable to dissolve or homogeneously disperse the ingredients in an organic solvent. Illustrative of suitable solvents are methyl ethyl ketone (MEK), dimethylformamide (DMF), chloroform, tetrahydrofuran (THF), dimethylacetamide (DMA), dioxane, dichloromethane and ethylene dichloride, or compatible mixtures of such organic solvents or with other organic solvents. A particularly useful solvent is a 50:50 mixture of dichloromethane and methyl ethyl ketone. After the solution or homogeneous dispersion is filmed on a substrate in any suitable manner, the major proportions of such organic solvent or solvents are evaporated off, preferably at a relatively low temperature and, sometimes desirably, under subatmospheric pressures or in vacuo, until the film or coating is substantially dry to the touch, such dry-to-the-touch coating being especially desirable for handling and processing purposes. Although such films or coatings may be, generally speaking, dry to the touch, it should be understood that this does not mean that the film is free from organic solvent. Indeed, it has been found that it is frequently very desirable that the finished films or coatings, prior to exposure to imaging energy, contain a small percentage, commonly of the general order of about 2 to 3%, by weight of the film or coating, or organic solvent, for instance, dimethylformamide (DMF) since its presence appears to play a favorable role in the sensitivity of the system in relation to the latent image formation and/or ultimate image obtained after the development step. The elimination of all or essentially all of the DMF, or other organic solvent or solvents, from the virgin film prior to the imaging and development frequently leads to a decrease in sensitivity. In any event, in any given instance where drying of the virgin imaging film has been carried out to a point where essentially no organic solvent is present, and whereby sensitivity is unduly reduced, sensitivity can be increased or restored by adding a small amount of organic solvent to the film prior to exposing it to imaging energy.

The imaging film or coating thickness are variable but will usually fall within the range of about 1 to about 35 μm with about 5 to 15 μm generally being a good average. In thickness in terms of millimeters (mm), such may vary from about 0.0005 to about 0.05 mm, or much greater, such as from 0.05 to 5 mm, the selected thickness being dependent upon the particular use to which the imaging film is to be put.

The production of the imaging organo-tellurium materials, and the coating, handling and processing operations, to the extent which may be required, are carried out under appropriate light conditions, as those skilled in the art will readily understand. For instance, the formulation of the coating compositions and the coating and drying operations are conveniently carried out under amberlite filtered light (weak transmission at 550 nm). The dry film, prior to imaging, is desirably stored in the dark. In certain cases, avoidance of contact of certain of the ingredients with certain metals may be in order where undesired reactions, such as reductions, may occur. In general, the vessels or containers, stirrers, etc., utilized should be made of glass or other vitreous materials or other materials inert to the coating ingredients to insure against contamination or possible undesired reactions. It is advantageous, in general, to prepare the imaging compositions shortly prior to coating them on the selected substrate. Under suitable storage conditions, which generally are conditions of darkness and reasonable avoidance of air or oxidizing atmospheres and humidity conditions, the stability of the imaging compositions is good.

In the imaging compositions, the proportions of the matrix, the imaging organo-tellurium material and the reductant precursor are variable. In those special cases where the imaging organo-tellurium material utilized is one which also inherently or concomitantly possesses desired sensitizing properties, as noted above, a separate reductant precursor is not necessary. It may, however, even in such cases, be desirable to employ a separate or added reductant precursor which may be of entirely different sensitizing properties from that inherently possessed by the particular imaging organo-tellurium material utilized. In any event, generally speaking, excluding the organic solvent or solvents, where employed as described below, at least in most cases the matrix material, which is a normally solid material, that is, solid at room temperature, will be employed in amounts in excess of any one of the other materials and will also usually be present in major amount, that is more than 50% and broadly in the range up to 90% by weight, of the total materials present in the imaging composition. The imaging organo-tellurium material, generally also a normally solid material, will ordinarily constitute from about 1 to above 20 parts per 100 parts of matrix, usually about 5–10 parts per 100 parts of matrix. The reductant precursor, where it is a separate ingredient, which is usually a solid, will usually be employed in lesser proportions, commonly of the order of about 5 to 20%, usually about 6 to 15%, by weight, of the imaging composition, although, in certain cases the proportions thereof can be substantially higher, approximately or even exceeding somewhat the proportions of the imaging organo-tellurium material. With further regard to the proportions of the aforesaid ingredients, it may be stated that the area density of the reductant precursor is desirably selected so that about 70–95% of the photons falling on the film in the region of the absorption bands of the reductant precursor are absorbed. Considerably higher concentrations of reductant precursor would leave the dark side of the film unexposed and no advantage would thus be served. In general, for optimal results in many cases, the mole concentration of the imaging organo-tellurium material should be reasonably close to or roughly approximate to that of the reductant precursor. The concentration of the polymer matrix material should be sufficient to produce an essentially amorphous film without bringing about precipitation of the imaging organo-tellurium material, the sensitizer and other supplemental ingredients when utilized. Excess polymer matrix material also tends to decrease the sensitivity of the film.

The amount of diol should be present in a concentration sufficient to provide at least 2 moles of diol for each mole of tellurium compound, and preferably to provide up to a ratio of 6:1 moles. As indicated above, our work has suggested that a complex is formed between the diol and the tellurium compound in a molar ratio of 2:1, and that excess diol above that is useful to provide a source of labile hydrogen for reaction with the reductant precursor. Larger amounts of the diol may be used if desired. To some extent, improved results are obtained when these larger amounts of diol are used; however, there is a point of diminishing returns above which increasing the amount of diol will not provide commensurate improvement in photoresponse of the finished film.

The masked reducing agent may be present in amounts of 1% up to 200% by weight of the tellurium compounds. Measurably improved sensitivity can be found in accordance with the present invention with even very small amounts of masked reducing agent and within limitations the degree of improvement is in proportion to the amount of masked reducing agent which is incorporated in the film. Again, however, a law of diminishing returns is observed, and while large amounts of the masked reducing agent will be incorporated, on the order of 2 to 4 times the amount of tellurium compound, beyond these large amounts the increase in photoresponse obtained is not commensurate with the increased amount of masked reducing agent incorporated.

The film-forming compositions as described above will be applied to any suitable substrate. Glass, porcelain, paper and various plastic substrates have been found suitable. For the purposes of forming film-like materials, transparency is obviously desirable. For this purpose, film of polyethylene terephthalate have been found particularly suitable. Other substrates include, for example, polyimides, nylon and triacetyl cellulose.

Fixing: After exposure and development, which development may be accomplished by heating, the film may be fixed as described in U.S. Pat. No. 4,142,896. The film may also be fixed by contacting the film with an alcohol, such as isopropanol, for example. A small amount of a ketone such as acetone, for example, may also be included with the alcohol. Especially useful is a solution of 50 parts isopropanol/1 part acetone (by volume).

Additional considerations which those skilled in the art in formulating and using tellurium-based film compositions may utilize are apparent from U.S. Pat. No. 4,142,896.

This invention is further illustrated by the following examples:

EXAMPLE 1

A tellurium imaging film not in accordance with the invention was made and tested. 0.625 grams of bis-(acetophenone) tellurium dichloride, 0.300 grams of isopropoxynaphthoquinone (IPNQ), 0.625 grams of a masked 1-phenyl-3-pyrazolidone:

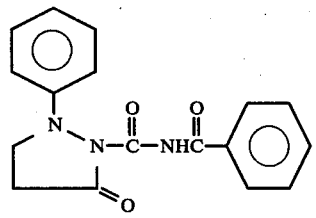

2.4 grams of ortho-methoxy benzyl glyceryl ether, 10.42 grams of CAB-500-5 containing an additional 1.5 milliliters of water and 160 milliliters of a 50:50 mixture (by volume) of methylene dichloride and methyl ethyl ketone were stirred together in complete darkness at room temperature until a homogeneous viscous solution was obtained. The solution was then coated on a MYLAR substrate at an area coverage of approximately 2 grams of bis(acetophenone) tellurium dichloride per square meter, and the resulting film heated in an oven at 50°-55° C. for three hours.

The photographic response of the film was tested by exposing the film to imaging energy through a photographic step tablet having eleven steps and an optical density range of approximately 0.5 to 3.05. The step tablet was in contact with the film during exposure. A Honeywell Strobonar Model No. 710 Xenon flash tube was utilized to provide imaging energy, spaced approximately ten inches from the film. After exposure, the film was developed by heating the film at a temperature of 150°-155° C. for 40-45 seconds. The maximum optical density (OD MAX) of the film was 2.85 and the minimum optical density or fog (OD MIN) was 0.41, as measured with a MacBeth Model T-P 504 Densitometer using a red filter. The speed of the film at an optical density of one over fog was calculated to be 30,000 ergs/cm$^2$.

EXAMPLE 2

The same procedure set forth in Example 1 was utilized to make and test the film except that several films were made in accordance with the invention by including varying amounts of sodium hydroxide into the compositions. The following results were obtained:

| Amount of NaOH (milligrams) | Speed @ OD of one over fog (erg/cm$^2$) | OD MIN | OD MAX |
|---|---|---|---|
| 7.3 | 9,500 | 0.51 | 2.00 |
| 7.6 | 7,100 | 0.37 | 2.00 |
| 7.9 | 7,600 | 0.45 | 2.03 |

EXAMPLE 3

The same procedure as set forth in Example 1 was utilized to make and test the film except that several films were made in accordance with the invention by including varying amounts of potassium hydroxide into the compositions. The following results were obtained:

| Amount of KOH (milligrams) | Speed @ OD of one over fog (erg/cm$^2$) | OD MIN | OD MAX |
|---|---|---|---|
| 7.68 | 4,500 | 0.54 | 2.57 |
| 7.98 | 3,200 | 0.40 | 2.44 |
| 8.28 | 3,500 | 0.60 | 2.69 |

EXAMPLE 4

The same procedures as set forth in Example 1 was utilized to make and test the film except that several films were made in accordance with the invention by including varying amounts of lithium hydroxide ($LiOH.H_2O$) into the compositions. The following results were obtained:

| Amount of ($LiOH.H_2O$) (milligrams) | Speed @ OD of one over fog (erg/cm$^2$) | OD MIN | OD MAX |
|---|---|---|---|
| 2.0 | 3,600 | 0.46 | 2.39 |
| 3.0 | 3,200 | 0.45 | 2.61 |
| 4.0 | 4,700 | 0.45 | 2.43 |

EXAMPLE 5

A tellurium imaging film not in accordance with the invention was made and tested. This film was made and tested utilizing the same procedure and components as set forth in Example 1, except that an optional component was added to the film, namely an alcohol, n-butanol. 3.0 milliliters of n-butanol were utilized. The following results were obtained: Speed at an optical density of one over fog, 3,000 ergs/cm$^2$; minimal optical density, 0.60; maximum optical density 2.28.

EXAMPLE 6

Films were made and tested utilizing the same procedure as set forth in Example 5 in which varying amounts of sodium hydroxide were included in the compositions. The following results were obtained:

| Amount of NaOH (milligrams) | Speed @ OD of one over fog (erg/cm$^2$) | OD MIN | OD MAX |
|---|---|---|---|
| 5.7 | 4,800 | 0.50 | 2.80 |
| 6.65 | 4,600 | 0.52 | 2.68 |
| 7.6 | 2,200 | 0.48 | 2.78 |
| 8.55 | 9,800 | 0.58 | 2.78 |
| 9.5 | 6,300 | 0.51 | 2.53 |
| 11.4 | 3,400 | 0.65 | 2.63 |
| 15.2 | 3,100 | 0.58 | 2.54 |
| 20.0 | 4,600 | 0.53 | 2.31 |
| 40.0 | 9,400 | 0.49 | 2.03 |

EXAMPLE 7

The same procedure as set forth in Example 5 was utilized to make and test films except that the films were made in accordance with the invention by including varying amounts of potassium hydroxide into the compositions. The following results were obtained:

| Amount of KOH (milligrams) | Speed @ OD of one over fog (erg/cm$^2$) | OD MIN | OD MAX |
|---|---|---|---|
| 5.32 | 4,700 | 0.52 | 2.95 |
| 6.65 | 2,200 | 0.58 | 3.02 |
| 7.32 | 2,800 | 0.55 | 2.73 |
| 7.98 | 2,800 | 0.50 | 2.70 |
| 8.65 | 3,300 | 0.56 | 2.78 |
| 9.31 | 3,400 | 0.54 | 2.81 |
| 10.64 | 3,500 | 0.56 | 2.80 |
| 11.97 | 7,800 | 0.53 | 2.73 |

EXAMPLE 8

The same procedure as set forth in Example 5 was utilized to make and test films except that the films were made in accordance with the invention incorporating varying amounts of ammonium hydroxide into the compositions. The following results were obtained:

| Amount of $NH_4OH$ (milligrams) | Speed @ OD of one over fog (erg/cm$^2$) | OD MIN | OD MAX |
|---|---|---|---|
| 6.65 | 20,000 | 0.52 | 2.72 |
| 7.48 | 7,400 | 0.49 | 2.64 |
| 7.90 | 2,600 | 0.67 | 2.47 |
| 8.31 | 2,800 | 0.54 | 2.80 |
| 9.98 | 4,700 | 0.54 | 2.77 |
| 10.0 | 4,800 | 0.43 | 3.00 |
| 50.0 | 9,600 | 0.57 | 2.36 |

EXAMPLE 9

The same procedure as set forth in Example 5 was utilized to make and test films except that the films were made in accordance with the invention by including varying amounts of lithium hydroxide ($LiOH.H_2O$) into the compositions. The following results were obtained:

| Amount of ($LiOH.H_2O$) (milligrams) | Speed @ OD of one over fog (erg/cm$^2$) | OD MIN | OD MAX |
|---|---|---|---|
| 2.0 | 4,000 | 0.46 | 2.39 |
| 2.5 | 2,800 | 0.45 | 2.40 |
| 3.0 | 1,800 | 0.47 | 3.12 |
| 3.5 | 2,100 | 0.46 | 2.63 |
| 4.0 | 2,000 | 0.61 | 2.82 |
| 5.0 | 2,300 | 0.58 | 2.44 |
| 6.0 | 2,600 | 0.46 | 2.73 |
| 9.0 | 2,800 | 0.52 | 2.80 |

EXAMPLE 10

The same procedure as set forth in Example 5 was utilized to make and test films except that the films were made in accordance with the invention by including amounts of various metal hydroxides into the compositions. Specifically, calcium hydroxide, barium hydroxide, rubidium hydroxide, cesium hydroxide and magnesium hydroxide were utilized. The following results were obtained:

| Additive | Amount of Additive (milligrams) | Speed @ OD of one over fog (erg/cm$^2$) | OD MIN | OD MAX |
|---|---|---|---|---|
| $Ca(OH)_2$ | 10.6 | 2,300 | 0.42 | 2.46 |
| $Ba(OH)_2.8H_2O$ | 45.0 | 2,800 | 0.48 | 2.34 |
| RbOH | 14.65 | 2,200 | 0.48 | 2.82 |
| CsOH | 21.15 | 2,600 | 0.55 | 2.83 |
| $Mg(OH)_2$ | 3.86 | 4,400 | 0.51 | 2.80 |
| $Mg(OH)_2$ | 7.72 | 3,100 | 0.50 | 2.87 |

While the foregoing additives illustrate an improvement in either the film speed and/or an improvement in the optical densities, when utilized in the foregoing amounts, a precipitate was present in the film because of the poor solubility of the additives.

EXAMPLE 11

The same procedure as set forth in Example 5 was utilized to make and test films except that the films were made in accordance with the invention by including varying amounts of n-tetradecylamine ($n\text{-}C_{14}H_{29}NH_2$) into the compositions. The following results were obtained:

| Amount of $n\text{-}C_{14}H_{29}NH_2$ (milligrams) | Speed @ OD of one over fog (erg/cm$^2$) | OD MIN | OD MAX |
|---|---|---|---|
| 20.67 | 3,800 | 0.46 | 2.57 |
| 23.0 | 3,200 | 0.50 | 2.76 |
| 24.0 | 3,000 | 0.58 | 2.86 |
| 25.4 | 2,400 | 0.43 | 2.42 |
| 26.0 | 3,600 | 0.60 | 2.91 |
| 29.0 | 3,600 | 0.57 | 2.88 |
| 31.4 | 3,600 | 0.56 | 2.75 |

EXAMPLE 12

The same procedure as set forth in Example 5 was utilized to make and test films except that the films were made in accordance with the invention by including varying amounts of pyridine into the compositions. The following results were obtained:

| Amount of Pyridine (milligrams) | Speed @ OD of one over fog (erg/cm$^2$) | OD MIN | OD MAX |
|---|---|---|---|
| 7.5 | 4,800 | 0.62 | 3.21 |
| 8.82 | 5,300 | 0.63 | 3.23 |
| 9.38 | 5,100 | 0.59 | 3.03 |
| 10.3 | 4,700 | 0.59 | 2.95 |
| 11.2 | 3,800 | 0.62 | 2.93 |
| 15.0 | 2,700 | 0.57 | 3.06 |
| 16.8 | 8,400 | 0.61 | 3.00 |

EXAMPLE 13

The same procedure as set forth in Example 5 was utilized to make and test films except that the films were made in accordance with the invention by including varying amounts of methylamine into the compositions. The following results were obtained:

| Amount of $CH_3NH_2$ (milligrams) | Speed @ OD of one over fog (erg/cm$^2$) | OD MIN | OD MAX |
|---|---|---|---|
| 4.4 | 3,000 | 0.56 | 3.13 |
| 5.1 | 3,600 | 0.53 | 3.07 |
| 5.7 | 3,600 | 0.50 | 2.95 |
| 6.65 | 4,700 | 0.53 | 3.03 |
| 7.30 | 2,800 | 0.55 | 3.05 |
| 8.80 | 4,000 | 0.58 | 3.27 |
| 10.3 | 4,500 | 0.52 | 3.07 |

EXAMPLE 14

The same procedure as set forth in Example 5 was utilized to make and test films except that the films were made in accordance with the invention by including varying amounts of piperidine into the compositions. The following results were obtained.

| Amount of Piperidine (milligrams) | Speed @ OD of one over fog (erg/cm$^2$) | OD MIN | OD MAX |
|---|---|---|---|
| 8.0 | 3,300 | 0.54 | 2.85 |
| 9.0 | 2,400 | 0.51 | 2.75 |
| 10.0 | 2,400 | 0.56 | 2.85 |
| 11.10 | 3,400 | 0.59 | 2.71 |
| 12.1 | 2,400 | 0.56 | 2.85 |
| 14.1 | 4,400 | 0.50 | 3.58 |
| 16.2 | 4,600 | 0.63 | 2.90 |

I claim:

1. A film for forming an image made from an image forming composition which image forming composition comprises:

(a) a tellurium imaging compound;

(b) a reductant precursor which will abstract labile hydrogen from a hydrogen donor under the influence of activating radiation to become a reducing agent with respect to the image forming tellurium compound;

(c) a masked reducing agent which ionizes under the influence of a base;

(d) a source of labile hydrogen for reaction with said reductant precursor;

(e) an inorganic base which is capable of ionizing the masked reducing agent, said base being present in an amount of ionize at least a portion of the masked reducing agent present in the composition; and (f) a matrix in which said tellurium compound, reductant precursor, masked reducing agent, source of labile hydrogen and base are combined in amounts effective to form a composition which may be applied to a substrate.

2. The film as recited in claim 1, wherein there is additionally provided in said composition a diol of the formula

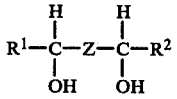

wherein each of $R^1$ and $R^2$ independently represents hydrogen, a hydrocarbon group, including straight chain, branched chain and cyclic hydrocarbon groups, hydroxyalkyl groups, alkoxycarbonyl groups, cycloalkyl groups or aryl groups; and Z represents a direct C—C bond between the carbon atoms on either side of it, or an arylene group, the group (—C≡C—), the group $(—CR^3=CR^4)_n$, wherein n represents 1 or 2, and each of $R^3$ and $R^4$ represents hydrogen or an alkyl group or taken from part of a carbocyclic or heterocyclic ring, said diol being provided in an amount equivalent to at least 2 moles thereof per 1 mole of said tellurium forming compound.

3. The film as recited in claim 1, wherein there is provided a diol of the formula $$R^7—X—CH_2—CHOH—CH_2OH$$

wherein $R^7$ is alkyl, alkanoyl, thiazolinyl, alkenyl, benzyl, alkylbenzyl, alkoxybenzyl, hydroxyalkylbenzyl, or halobenzyl; the alkyl radical having from 1 to 7 carbon atoms; and X is oxygen or sulphur.

4. The film as recited in claim 1, wherein said tellurium compound is selected from the group consisting of $R_x—Te—Haly$;
$(Hal—R^8)_x—Te—Haly$; and
$TeCl_nBr_m$ in the foregoing formulae, R being an organic radical containing at least 1 carbonyl group, $R^8$ being the residue of an ethylenic hydrocarbon, Hal being halogen, x being 1, 2 or 3; and x+y=4; n being an integer from 1 to 4 and m+n=4.

5. The film as recited in claim 3, wherein said masked reducing agent is selected from the group consisting of:

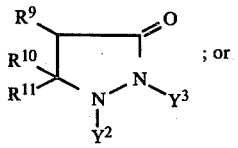

(b)

; or

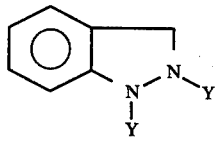

(c)

wherein $R^8$ is alkyl, alkanoyl, alkoxycarbonyl, phenyl, benzyl, benzoyl, nitrophenyl, benzylcarbonyl, diphenylmethyl, diphenylethyl, diphenylpropylcarbonyl or amino carbonyl; $R^9$, $R^{10}$ and $R^{11}$ each and independently are hydrogen, alkyl, phenyl or amino; and $R^{12}$ is phenyl, nitrophenyl, halophenyl, alkyl, mono-, di-, or tri-haloacetyl, benzoyl, alkylphenyl, or alkyl-p-isocyanophenyl, said alkyl grouping in the radicals $R^8$ through $R^{12}$ having 1 to 7 carbon atoms, and wherein Y is hydrogen or

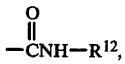

compounds (a) and (c) each containing at least one

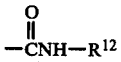

group, and wherein $Y^2$ is Y or phenyl and $Y^3$ is Y or

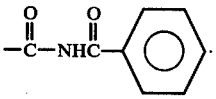

6. The film according to claim 1 wherein said reductant precursor is selected from the group consisting of 2-isopropoxy-1,4-naphthoquinone; 2-t-butylanthraquinone; 1,10-phenanthrenequinone; 1,1'-dibenzoylferrocene; 1-phenyl-1,2-propanedione; 2-hydroxy-1,4-naphthoquinone; benzil; furil; diacetylferrocene; acetylferrocene; 1,4-bis (phenyl glyoxal) benzene; o-naphthoquinone; 4,5-pyrinequinone; 4,5,9,10-pyrinequinone; benzophenone; acetophenone; 1,5-diphenyl-1,3,5-pentanetrione; ninhydrin; 4,4'-dibromobenzophenone; 1,8-dichloroanthraquinone; 1,2-benzanthraquinone; 2-methylanthraquinone; 1-chloroanthraquinone; 7,8,9,10-tetrahydronaphthacenequinone; 9,10-anthraquinone; and 1,4-dimethylanthraquinone.

7. The film as recited in claim 1 wherein there is additionally provided water in said composition.

8. The film as recited in claim 1 wherein there is additionally provided an alcohol in said composition.

9. The film as recited in claims 1, 2, 3, 4, 5, 6, 7 or 8 wherein said base is selected from the group consisting of alkali metal hydroxides and alkaline earth metal hydroxides.

10. The film as recited in claims 1, 2, 3, 4, 5, 6, 7 or 8 wherein said base comprises lithium hydroxide.

11. The film as recited in claims 1, 2, 3, 4, 5, 6, 7 or 8 wherein said base comprises sodium hydroxide.

12. The film as recited in claims 1, 2, 3, 4, 5, 6, 7 or 8 wherein said base comprises potassium hydroxide.

13. The film as recited in claim 1 wherein said base is selected from the group consisting of rubidium hydroxide, cesium hydroxide, magnesium hydroxide, calcium hydroxide and barium hydroxide.

14. The film as recited in claims 1, 2, 3, 4, 5, 6, 7 or 8 wherein said base comprises ammonium hydroxide.

15. A composition responsive to activating energy for forming an imaging film, which composition comprises:

(a) a tellurium imaging compound;

(b) a reductant precursor which will abstract labile hydrogen from a hydrogen donor under the influence of activating radiation to become a reducing agent with respect to the image forming tellurium compound;

(c) a masked reducing agent which ionizes under the influence of a base;

(d) a source of labile hydrogen for reaction with said reductant precursor;

(e) an inorganic base which is capable of ionizing the masked reducing agent, said base being present in an amount to ionize at least a portion of the masked reducing agent present in the composition; and (f) a matrix in which said tellurium compound, reductant precursor, masked reducing agent, source of labile hydrogen and base are combined in amounts effective to form a composition which may be applied to a substrate.

16. The composition as recited in claim 15, wherein there is additionally provided a diol of the formula

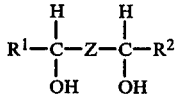

wherein each of $R^1$ and $R^2$ independently represents hydrogen, a hydrocarbon group, including straight chain, branched chain and cyclic hydrocarbon groups, hydroxyalkyl groups, alkoxycarbonyl groups, cycloalkyl groups or aryl groups; and Z represents a direct C—C bond between the carbon atoms on either side of it, or an arylene group, the group (—C≡C—), the group $(—CR^3=CR^4)_n$, wherein n represents 1 or 2, and each of $R^3$ and $R^4$ represents hydrogen or an alkyl group or taken from part of a carbocyclic or heterocyclic ring, said diol being provided in an amount equivalent to at least 2 moles thereof per 1 mole of said tellurium forming compound.

17. The composition as recited in claim 15, wherein there is provided a diol of the formula $$R^5—X—CH_2—CHOH—CH_2OH$$

wherein $R^5$ is alkyl, alkanoyl, thiazolinyl, alkenyl, benzyl, alkylbenzyl, alkoxybenzyl, hydroxyalkylbenzyl, and halobenzyl; the alkyl radical having from 1 to 7 carbon atoms; and X is oxygen or sulphur.

18. The composition as recited in claim 15, wherein said tellurium compound is selected from the group consisting of $$R_x^6—Te—Haly;$$
$$(Hal—R^7)_x—Te—Haly; \text{ and}$$
$$TeCl_nBr_m$$

in the foregoing formulae, $R^6$ being an organic radical containing at least 1 carbonyl group, $R^7$ being the residue of an ethylenic hydrocarbon, Hal being halogen, x being 1, 2 or 3; and x+y=4; n being an integer from 1 to 4 and m+n=4.

19. The composition as recited in claim 17, wherein said masked reducing agent is of the formula:

(a) $R^8—NY—NY_2$;

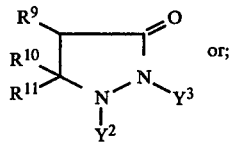

(b)

or;

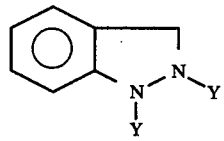

(c)

wherein $R^8$ is alkyl, alkanoyl, alkoxycarbonyl, phenyl, benzyl, benzoyl, nitrophenyl, benzylcarbonyl, diphenylmethyl, diphenylethyl, diphenylpropylcarbonyl or amino carbonyl; $R^9$, $R^{10}$ and $R^{11}$ each and independently are hydrogen, alkyl, phenyl or amino; and $R^{12}$ is phenyl, nitrophenyl, halophenyl, alkyl, mono-, di-, or tri-haloacetyl, benzoyl, alkylphenyl, or alkyl-p-isocyanophenyl, said alkyl grouping in the radicals $R^8$ through $R^{12}$ having 1 to 7 carbon atoms, and wherein Y is hydrogen or $$—\overset{O}{\overset{\|}{C}}NH—R^{12},$$

compounds (a) and (c) each containing at least one $$—\overset{O}{\overset{\|}{C}}NH—R^{12}$$

group, and wherein $Y^2$ is Y or phenyl and $Y^3$ is Y or

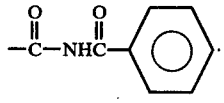

20. The composition as recited in claim 15, wherein said reductant precursor is selected from the group consisting of 2-isopropoxy-1,4-naphthoquinone; 2-t-butyl-anthraquinone; 1,10-phenanthrenequinone; 1,1'-dibenzoylferrocene; 1-phenyl-1,2-propanedione; 2-hydroxy-1,4-naphthoquinone; benzil; furil; diacetylferrocene; acetylferrocene; 1,4-bis(phenyl glyoxal) benzene; o-naphthoquinone; 4,5-pyrinequinone; 4,5,9,10-pyrinequinone; benzophenone; acetophenone; 1,5-diphenyl-1, 3,5-pentanetrione; ninhydrin; 4,4'- dibromobenzophenone; 1,8-dichloroanthraquinone; 1,2-benzanthraquinone; 2-methylanthraquinone; 1-chloroanthraquinone; 7,8,9,10-tetrahydronaphthacenequinone; 9,10-anthraquinone; and 1,4-dimethylanthraquinone.

21. The composition as recited in claims 15, 16, 17, 18, 19 or 20 wherein said base is selected from the group consisting of alkali metal hydroxides, alkaline earth metal hydroxides and ammonium hydroxide.

22. The composition as recited in claim 21 wherein said base is selected from the group consisting of lithium hydroxide, sodium hydroxide, potassium hydroxide, rubidium hydroxide, cesium hydroxide, magnesium hydroxide, calcium hydroxide, and barium hydroxide.

23. The film made from the composition of one of claims 15, 16, 17, 18, 19 or 20.

24. A method for recording electromagnetic radiation, wherein said method comprises imagewise impinging said radiation upon a photosensitive film to produce a change in at least one property thereof, which film is made from a photosensitive composition carried by a substrate, the photosensitive composition comprising:

(a) a tellurium imaging compound;

(b) a reductant precursor which will abstract labile hydrogen from a hydrogen donor under the influence of activating radiation to become a reducing agent with respect to the image forming tellurium compound;

(c) a masked reducing agent which ionizes under the influence of a base;

(d) a source of labile hydrogen for reaction with said reductant precursor;

(e) an inorganic base which is capable of ionizing the masked reducing agent, said base being present in an amount to ionize at least a portion of the masked reducing agent present in the composition; and (f) a matrix in which said tellurium compound, reductant precursor, masked reducing agent, source of labile hydrogen and base are combined in amounts effective to form a photosensitive composition which may be applied to a substrate.

25. The method as recited in claim 24, wherein there is additionally provided a diol of the formula

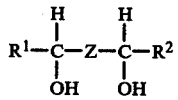

wherein each of $R^1$ and $R^2$ independently represents hydrogen, a hydrocarbon group, including straight chain, branched chain and cyclic hydrocarbon groups, hydroxyalkyl groups, alkoxycarbonyl groups, cycloalkyl groups or aryl groups; and Z represents a direct C—C bond between the carbon atoms on either side of it, or an arylene group, the group (—C≡C—), the group $(—CR^3=CR^4)_n$, wherein n represents 1 or 2, and each of $R^3$ and $R^4$ represents hydrogen or an alkyl group or taken from part of a carbocyclic or heterocyclic ring, said diol being provided in an amount equivalent to at least 2 moles thereof per 1 mole of said tellurium forming compound.

26. The method as recited in claim 24, wherein there is provided a diol of the formula $$R^5—X—CH_2—CHOH—CH_2OH$$

wherein $R^5$ is alkyl, alkanoyl, thiazolinyl, alkenyl, benzyl, alkylbenzyl, alkoxybenzyl, hydroxyalkylbenzyl, and halobenzyl; the alkyl radical having from 1 to 7 carbon atoms; and X is oxygen or sulphur.

27. The method as recited in claim 24, wherein said tellurium compound is selected from the group consisting of $R_x^6$—Te—Haly;
$(Hal—R^7)_x$—Te—Haly; and
$TeCl_nBr_m$ in the foregoing formulae, $R^6$ being an organic radical containing at least 1 carbonyl group, $R^7$ being the residue of an ethylenic hydrocarbon, Hal being halogen, x being 1, 2 or 3; and x+y=4; n being an integer from 1 to 4 and m+n=4.

28. The method as recited in claim 24, wherein said masked reducing agent is of the formula:

(a) $R^8—NY—NY_2$;

(b)

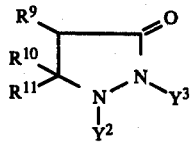

; or (c)

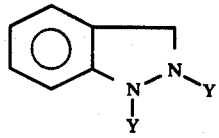

wherein $R^8$ is alkyl, alkanoyl, alkoxycarbonyl, phenyl, benzyl, benzoyl, nitrophenyl, benzylcarbonyl, diphenylmethyl, diphenylethyl, diphenylpropylcarbonyl or amino carbonyl; $R^9$, $R^{10}$ and $R^{11}$ each and independently are hydrogen, alkyl, phenyl or amino; and $R^{12}$ is phenyl, nitrophenyl, halophenyl, alkyl, mono-, di-, or tri-haloacetyl, benzoyl, alkylphenyl, or alkyl-p-isocyanophenyl, said alkyl grouping in the radicals $R^8$ through $R^{12}$ having 1 to 7 carbon atoms, and wherein Y is hydrogen or $$—\overset{O}{\overset{\|}{C}}NH—R^{12},$$

compounds (a) and (c) each containing at least one $$—\overset{O}{\overset{\|}{C}}NH—R^{12}$$

group, and wherein $Y^2$ is Y or phenyl and $Y^3$ is Y or

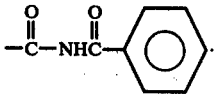

29. The method as recited in claim 24, wherein said reductant precursor is selected from the group consisting of 2-isopropoxy-1,4-naphthoquinone; 2-t-butylanthraquinone; 1,10-phenanthrenequinone; 1,1'-dibenzoylferrocene; 1-phenyl-1,2-propanedione; 2-hydroxy- 1,4-naphthoquinone; benzil; furil; diacetylferrocene; acetylferrocene; 1,4-bis (phenyl glyoxal) benzene; o-naphthoquinone; 4,5-pyrinequinone; 4,5,9,10-pyrinequinone; benzophenone; acetophenone; 1,5-diphenyl-1,3,5-pentanetrione; ninhydrin; 4,4'-dibromobenzophenone; 1,8-dichloroanthraquinone; 1,2-benzanthraquinone; 2-methylanthraquinone; 1-chloroanthraquinone; 7,8,9,10-tetrahydronaphthacenequinone; 9,10-anthraquinone; and 1,4-dimethylanthraquinone.

30. The method as recited in claims 24, 25, 26, 27, 28 or 29 wherein said base is selected from the group consisting of alkali metal hydroxides, alkaline earth metal hydroxides and ammonium hydroxide.

31. The method as recited in claim 30 wherein said base is selected from the group consisting of lithium hydroxide, sodium hydroxide, potassium hydroxide, rubidium hydroxide, cesium hydroxide, magnesium hydroxide, calcium hydroxide, and barium hydroxide.

32. A composition responsive to activating energy for forming an imaging film, which composition comprises:

(a) an image forming organo-metallic compound;

(b) a reductant precursor which will abstract labile hydrogen from a hydrogen donor under the influence of activating radiation to become a reducing agent with respect to the image forming oragno-metallic compound;

(c) a masked reducing agent which ionizes under the influence of a base;

(d) a source of labile hydrogen for reaction with said reductant precursor;

(e) an inorganic base which is capable of ionizing the masked reducing agent, said base being present in an amount to ionize at least a portion of the masked reducing agent present in the composition; and (f) a matrix in which said organo-metallic compound, reductant precursor, masked reducing agent, source of labile hydrogen and based are combined in amounts effective to form a composition which may be applied to a substrate.

33. The composition as recited in claim 32, wherein there is additionally provided in said composition a diol of the formula

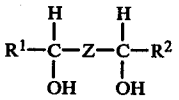

wherein each of $R^1$ and $R^2$ independently represents hydrogen, a hydrocarbon group, including straight chain, branched chain and cyclic hydrocarbon groups, hydroxyalkyl groups, alkoxycarbonyl groups, cycloalkyl groups or aryl groups; and Z represents a direct C—C bond between the carbon atoms on either side of it, or an arylene group, the group (—C≡C—), the group $(—CR^3=CR^4)_n$, wherein n represents 1 or 2, and each of $R^3$ and $R^4$ represents hydrogen or an alkyl group or taken from part of a carbocyclic or heterocyclic ring, said diol being provided in an amount equivalent to at least 2 moles thereof per 1 mole of said image forming compound.

34. The composition as recited in claim 32, wherein there is provided a diol of the formula $$R^7—X—CH_2—CHOH—CH_2OH$$

wherein $R^7$ is alkyl, alkanoyl, thiazolinyl, alkenyl, benzyl, alkylbenzyl, alkoxybenzyl, hydroxyalkylbenzyl, and halobenzyl; the alkyl radical having from 1 to 7 carbon atoms; and X is oxygen or sulphur.

35. The composition as recited in claim 32, wherein said tellurium compound is selected from the group consisting of $$R_x—Te—Haly;$$
$$(Hal—R^8)_x—Te—Haly; \text{ and}$$
$$TeCl_nBr_m$$

in the foregoing formulae, R being an organic radical containing at least 1 carbonyl group, $R^8$ being the residue of an ethylenic hydrocarbon, Hal being halogen, x being 1, 2 or 3; and x+y=4; n being an integer from 1 to 4 and m+n=4.

36. The composition as recited in claim 34, wherein said masked reducing agent is selected from the group consisting of:

(a) $R^8—NY—NY_2$;

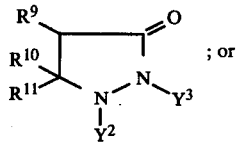

; or (b)

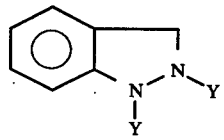

(c)

wherein $R^8$ is alkyl, alkanoyl, alkoxycarbonyl, phenyl, benzyl, benzoyl, nitrophenyl, benzylcarbonyl, diphenylmethyl, diphenylethyl, diphenylpropylcarbonyl or amino carbonyl; $R^9$, $R^{10}$ and $R^{11}$ each and independently are hydrogen, alkyl, phenyl or amino; and $R^{12}$ is phenyl, nitrophenyl, halophenyl, alkyl, mono-, di-, or tri-haloacetyl, benzoyl, alkylphenyl, or alkyl-p-isocyanophenyl, said alkyl grouping in the radicals $R^8$ through $R^{12}$ having 1 to 7 carbon atoms, and wherein Y is hydrogen or

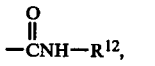

compounds (a) and (c) each containing at least one

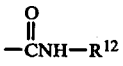

group, and wherein $Y^2$ is Y or phenyl and $Y^3$ is Y or

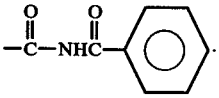

37. The composition according to claim 32 wherein said reductant precursor is selected from the group consisting of 2-isopropoxy-1,4-naphthoquinone; 2-t-butylanthraquinone; 1,10-phenanthrenequinone; 1,1'-dibenzoylferrocene; 1-phenyl-1,2-propanedione; 2-hydroxy-1,4-naphthoquinone; benzil; furil; diacetylferrocene; acetylferrocene; 1,4-bis (phenyl glyoxal) benzene; o-naphthoquinone; 4,5-pyrinequinone; 4,5,9,10-pyrinequinone; benzophenone; acetophenone; 1,5-diphenyl-1,3,5-pentanetrione; ninhydrin; 4,4'-dibromobenzophenone; 1,8-dichloroanthraquinone; 1,2-benzanthraquinone; 2-methylanthraquinone; 1-chloroanthraquinone; 7,8,9,10-tetrahydronaphthacenequinone; 9,10-anthraquinone; and 1,4-dimethylanthraquinone.

38. The composition as recited in claim 32 wherein there is additionally provided water in said composition.

39. The composition as recited in claim 32 wherein there is additionally provided an alcohol in said composition.

40. The composition as recited in claim 32 wherein said base is selected from the group consisting of alkali metal hydroxides and alkaline earth metal hydroxides.

41. The composition as recited in claim 32 wherein said base comprises lithium hydroxide.

42. The composition as recited in claim 32 wherein said base comprises sodium hydroxide.

43. The composition as recited in claim 32 wherein said base comprises potassium hydroxide.

44. An imaging film made from a composition as recited in one of claims 32–43.

45. A film for forming an image made from an image forming composition which image forming composition comprises:

(a) a tellurium imaging compound;

(b) a reductant precursor which will abstract labile hydrogen from a hydrogen donor under the influence of activating radiation to become a reducing agent with respect to the image forming tellurium compound;

(c) a masked reducing agent which ionizes under the influence of a base;

(d) a source of labile hydrogen for reaction with said reductant precursor; and (e) a base which is capable of ionizing the masked reducing agent, said base being present in an amount to ionize at least a portion of the masked reducing agent present in the composition, said base being of a type and present in an amount such that the speed of the film is improved; and (f) a matrix in which said tellurium compound, reductant precursor, masked reducing agent, source of labile hydrogen and base are combined in amounts effective to form a composition which may be applied to a substrate.

46. The film as recited in claim 45 wherein said base comprises an organic base.

47. The film as recited in claim 45 wherein said base is selected from the group consisting of aliphatic amine compounds and nitrogen atom containing heterocyclic compounds.

48. The film as recited in claim 46 wherein said organic base comprises a primary amine.

49. The film as recited in claim 46 wherein said organic base comprises a secondary amine.

50. The film as recited in claim 46 wherein said organic base comprises a tertiary amine.

51. The film as recited in claim 46 wherein said base is selected from the group consisting of methyl amine, ethyl amine, propyl amine and butyl amine.

52. The film as recited in claim 46 wherein said base comprises piperidine.

53. The film as recited in claim 46 wherein said organic base comprises pyridine.

54. A composition responsive to activating energy for forming an imaging film, which composition comprises:

(a) a tellurium imaging compound;

(b) a reductant precursor which will abstract labile hydrogen from a hydrogen donor under the influence of activating radiation to become a reducing agent with respect to the mage forming tellurium compound;

(c) a masked reducing agent which ionizes under the influence of a base;

(d) a source of labile hydrogen for reaction with said reductant precursor;

(e) a base which is capable of ionizing the masked reducing agent, said base being present in an amount to ionize at least a portion of the masked reducing agent present in the composition, said base being of a type and present in an amount such that the speed of the film is improved; and (f) a matrix in which said tellurium compound, reductant precursor, masked reducing agent, source of labile hydrogen and base are combined in amounts effective to form a composition which may be applied to a substrate.

55. A composition responsive to activating energy for forming an imaging film, which composition comprises:

(a) an image forming organo-metallic compound;

(b) a reductant precursor which will abstract labile hydrogen from a hydrogen donor under the influence of activating radiation to become a reducing agent with respect to the image forming organo-metallic compound;

(c) a masked reducing agent which ionizes under the influence of a base;

(d) a source of labile hydrogen for reaction with said reductant precursor;

(e) a base which is capable of ionizing the masked reducing agent, said base being present in an amount to ionize at least a portion of the masked reducing agent present in the composition, said base being of the type and present in an amount such that the speed of the film is improved; and (f) a matrix in which said organo-metallic compound, reductant precursor, masked reducing agent, source of labile hydrogen and base are combined in amounts effective to form a composition which may be applied to a substrate.

* * * * *

UNITED STATES PATENT AND TRADEMARK OFFICE

CERTIFICATE OF CORRECTION

PATENT NO. : 4,451,556

DATED : May 29, 1984

INVENTOR(S) : Terry Ta-Jen Yu

It is certified that error appears in the above-identified patent and that said Letters Patent is hereby corrected as shown below:

Column 2, line 19, "$PQ.H_2$" should read --$PQ \cdot H_2$--; line 21, should read --$(R^1)_2 \cdot Te \cdot X_2 + 2PQ \cdot H_2 \longrightarrow 2PQ + 2R^1H = Te + 2HX$--; line 25, "$PQ.H_2$" should read --$PQ \cdot H_2$--; line 27, "$(R^1)_2.Te.X_2$" should read --$(R^1)_2 \cdot Te \cdot X_2$--; line 32, "specially-provided" should read --specially provided--. Column 8, line 28, after "compounds" insert --which--. Column 9, line 31, "Change" should read --Chang--. Column 15, line 28, "or" should read --of--. Column 18, line 51, "are" should read --is--. Column 21, line 63, "procedures" should read --procedure--; line 67, "$OH.H_2O)$" should read --$OH \cdot H_2O)$--.

Column 22, line 3, "$(LiOH.H_2O)$" should read --$(LiOH \cdot H_2O)$--.

Column 23, line 18, "$(LiOH.H_2O)$" should read --$(LiOH \cdot H_2O)$--; line 24, "$(LiOH.H_2O)$" should read --$(LiOH \cdot H_2O)$--; line 50, "$Ba(OH)_2.8H_2O$" should read --$Ba(OH)_2 \cdot 8H_2O$--. Column 25, line 17, "of" (first occurrence) should read --to--; line 63, "Haly" should read --$Hal_y$--. Column 26, line 6, insert --$R^8 - NY - NY_2$; (a)-- . Column 28, lines 5 and 6, "Haly" should read --$Hal_y$--. Column 30, lines 10 and 11, "Haly" should read --$Hal_y$--. Column 31, line 25, " oragno- " should read -- organo- --; line 37, "based" should read --base--

UNITED STATES PATENT AND TRADEMARK OFFICE

CERTIFICATE OF CORRECTION

PATENT NO. : 4,451,556

DATED : May 29, 1984

INVENTOR(S) : Terry Ta-Jen Yu

It is certified that error appears in the above-identified patent and that said Letters Patent is hereby corrected as shown below:

Column 32, lines 8 and 9, "Haly" should read --$Hal_y$--.

Signed and Sealed this

*Tenth* Day of *December 1985*

[SEAL]

*Attest:*

DONALD J. QUIGG

*Attesting Officer*

*Commissioner of Patents and Trademarks*